US005959255A

United States Patent [19]

Langlie et al.

[11] Patent Number: 5,959,255

[45] Date of Patent: Sep. 28, 1999

[54] INSULATOR FOR CHAIN LINK FENCE

[75] Inventors: Ronald H. Langlie; Jon A. Berg, both of Ellendale, Minn.

[73] Assignee: North Central Plastics, Inc., Ellendale, Minn.

[21] Appl. No.: 09/021,797

[22] Filed: Feb. 11, 1998

[51] Int. Cl.[6] ..... H01B 17/16

[52] U.S. Cl. ..... 174/161 F; 248/74.1; 256/10

[58] Field of Search ..... 174/161 F, 163 F, 174/161 R, 158 R, 154, 158 F, 160, 171, 168, 175; 256/10, 50, 53, 48, 47; 248/72, 74.1, 63, 74.2

[56] References Cited

U.S. PATENT DOCUMENTS

| | | | |
|---|---|---|---|
| D. 248,750 | 8/1978 | Langlie et al. | D8/364 |
| D. 248,850 | 8/1978 | Langlie et al. | D8/364 |
| D. 330,008 | 10/1992 | Berg et al. | D13/128 |
| D. 331,221 | 11/1992 | Langlie et al. | D13/131 |
| 2,437,344 | 3/1948 | Behlmann | 174/163 F |
| 3,733,429 | 5/1973 | Berg, Jr. et al. | 174/161 F |
| 3,820,758 | 6/1974 | Berg, Jr. et al. | 256/10 |
| 4,028,489 | 6/1977 | Bert, Jr. et al. | 174/166 R |
| 4,077,611 | 3/1978 | Wilson | 256/10 |
| 4,263,477 | 4/1981 | Wilson, Sr. | 174/158 F |
| 4,599,488 | 7/1986 | Wilson, Jr. | 174/158 R |
| 4,623,756 | 11/1986 | Wilson, Jr. | 174/158 F |
| 4,866,218 | 9/1989 | Wilson, Jr. | 174/158 F |
| 4,982,932 | 1/1991 | Baker | 256/47 |
| 5,032,693 | 7/1991 | Langlie et al. | 174/158 F |
| 5,085,409 | 2/1992 | Teixeira | 256/48 |
| 5,412,158 | 5/1995 | Yearwood | 174/163 F |

FOREIGN PATENT DOCUMENTS

| | | | |
|---|---|---|---|
| 2187771 | 9/1987 | United Kingdom | 174/163 F |

OTHER PUBLICATIONS

Dave Products Inc. Advertising Brochure Reversed T Post Insulator, Undated.

*Primary Examiner*—Kristine Kincaid
*Assistant Examiner*—Dhiru R. Patel
*Attorney, Agent, or Firm*—Merchant, Gould, Smith, Edell, Welter, Schmidt, P.A.

[57] ABSTRACT

An insulator for attachment to a chain link fence and that is configured so as to support fence strand members generally parallel to the ground. The insulator includes an elongate body portion having first and second ends, with a mounting structure, preferably a clip structure, at the first end of the body portion for attaching the insulator to the chain link fence. A fence strand retainer is disposed at the second end of the body portion for retaining the electric fence strand member. The fence strand retainer is oriented at an acute angle relative to the mounting structure, with the acute angle preferably being about 45 degrees due to the pattern of the mesh forming the chain link fence, such that when the insulator is mounted on the chain link fence and the electric fence strand member is held by the fence strand retainer, the fence strand member will be oriented substantially parallel to the ground. The insulator is preferably an integral, one-piece construction made of a non-conducting material, preferably molded plastic.

11 Claims, 2 Drawing Sheets

INSULATOR FOR CHAIN LINK FENCE

FIELD OF THE INVENTION

The present invention relates to a one-piece insulator that is attached to a chain link fence and that holds fence strand members generally parallel to the ground, particularly for use in electric fencing systems.

BACKGROUND OF THE INVENTION

Often times it is desirable to supplement an existing chain link fence with additional fence strand members, such as electric wire or tape, barbed wire, etc. When the fence strand members are electrified, insulators must be used to support the electrified fence strand members on the chain link fence in order to insulate the fence from the electrified fence strand members.

A known support arrangement for supporting an electric wire 10 on a chain link fence 12 is illustrated in FIG. 1. In this conventional arrangement, a plastic insulator 14 includes a hole therein through which the wire 10 extends, with a spring steel clip 16 connected to the insulator and adapted to be attached to the mesh of the chain link fence 12. A plurality of these insulator and clip arrangements are connected to the fence to support the wire along its length, with the wire 10 being disposed generally parallel to the ground. The insulator and clip are made from different materials, so they must be manufactured individually and then secured together using a suitable fastening arrangement. This not only increases the assembly time of the support structure, which ultimately increases the cost of the support, but also can lead to loss of support of the wire if the connection between the insulator and the clip fails.

Therefore a need exists for an improved insulator that is able to support an electric fence strand member on a chain link fence, and that is simple to manufacture and has a long working life.

SUMMARY OF THE INVENTION

Therefore the general purpose of the present invention is to provide an insulator that can be attached to a chain link fence and that is configured so as to be able to support an electric fence strand member in a position generally parallel to the ground. The insulator is an integral, one-piece design of a non-conducting material, preferably a plastic material, and is elongated to increase the distance between the electric fence strand member and any other electrically conductive metal structure, such as the mesh or the support pipes of the fence, thereby lessening the chance of an electrical short circuit from occurring.

A preferred embodiment of the insulator in accordance with the principles of the present invention includes an elongate body portion having first and second ends, with a mounting structure, preferably a clip structure, at the first end of the body portion for attaching the insulator to the chain link fence. The mounting structure includes a central axis extending therethrough. A fence strand retainer is disposed at the second end of the body portion for retaining the electric fence strand member. The fence strand retainer defines a fence strand passage that is oriented at an acute angle relative to the central axis of the mounting structure, with the acute angle preferably being about 45 degrees due to the pattern of the mesh forming the chain link fence, such that when the insulator is mounted on the chain link fence and the electric fence strand member is held by the fence strand retainer, the fence strand member will be oriented substantially parallel to the ground.

The insulator is preferably an integral, one-piece construction made from a non-conducting material, preferably a plastic material. Since the components of the insulator, i.e. the body portion, mounting structure and fence strand retainer, are all integrally formed, there is no connector between the components that can fail, thereby increasing the life and reliability of the insulator. Further, the integral manufacture of insulator reduces manufacturing time and costs, since the insulator is formed as a single piece.

These and various other advantages and features of novelty which characterize the invention are pointed out with particularity in the claims annexed hereto and forming a part hereof. However, for a better understanding of the invention, its advantages and objects obtained by its use, reference should be made to the drawings which form a further part hereof, and to the accompanying description, in which there is described a preferred embodiment of the invention.

BRIEF DESCRIPTION OF THE DRAWINGS

Referring to the drawings, wherein like numerals represent like parts throughout the several views.

DETAILED DESCRIPTION OF THE PREFERRED EMBODIMENT

Figure 1:
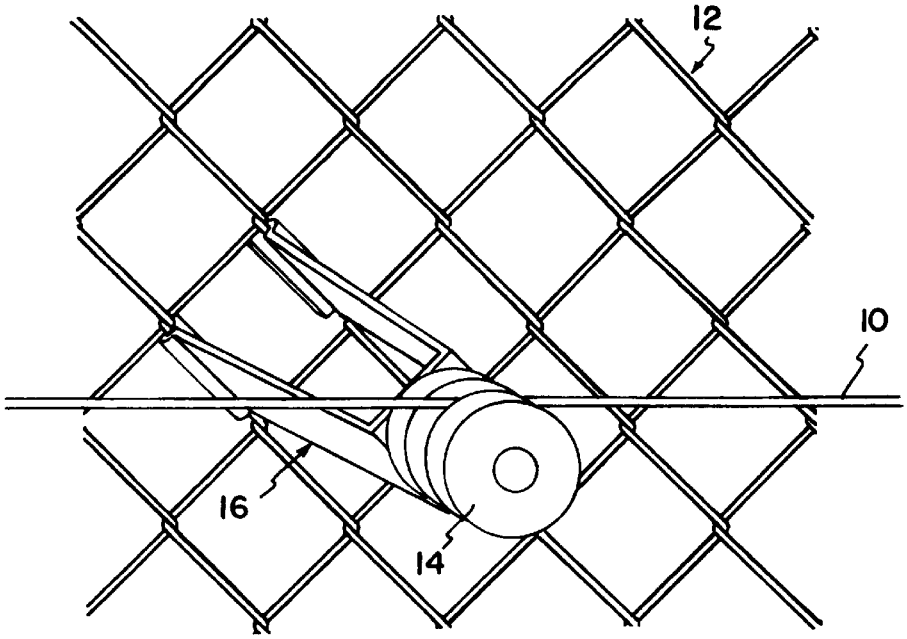
FIG. 1 (PRIOR ART)
FIG. 1 illustrates a conventional insulator and clip arrangement for supporting an electrified wire on a chain link fence.
Figure 2:
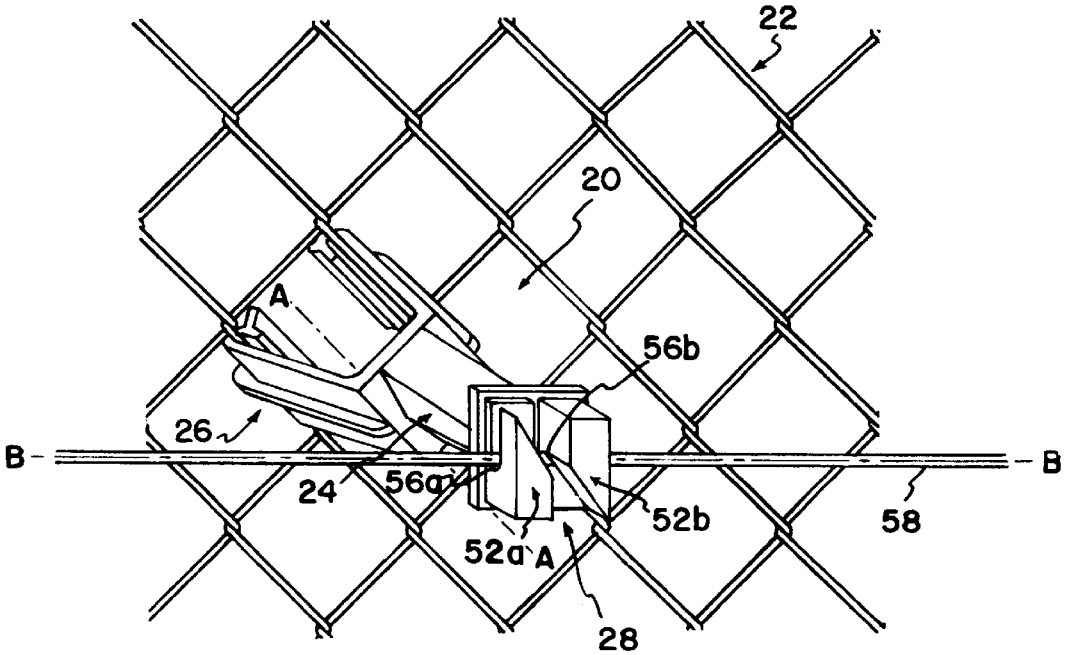
FIG. 2 illustrates an insulator in accordance with the principles of the present invention, attached to a chain link fence.

With reference to FIG. 2, an insulator 20 in accordance with the principles of the present invention is illustrated as being attached to a conventional chain link fence 22. As is typical, the fence 22 includes a series of perpendicular criss-crossing wires arranged at 45 degree angles to horizontal, thus forming a diamond patterned mesh.

The insulator 20 is an integrally formed, one-piece construction made from a non-conducting material, such as plastic, and includes an elongate body portion 24, a mounting clip structure 26 at one end of the body portion 24, and a fence strand retainer 28 at the opposite end of the body portion. The insulator 20 can be made by a variety of different methods in order to form a unitary, one-piece structure. For instance, the insulator 20 can be made by injection molding a plastic material, such as polyethylene, so that the body portion 24, mounting clip structure 26 and the fence strand retainer 28 are formed integrally as a single unitary structure.

Figure 5:
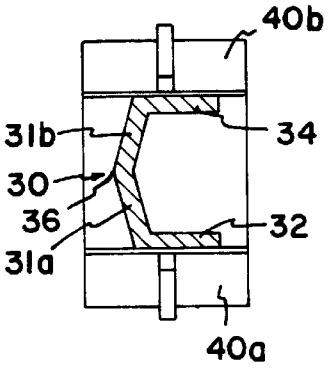
FIG. 5 is a cross-sectional view taken along line 5—5 of FIG. 3.
Figure 3:
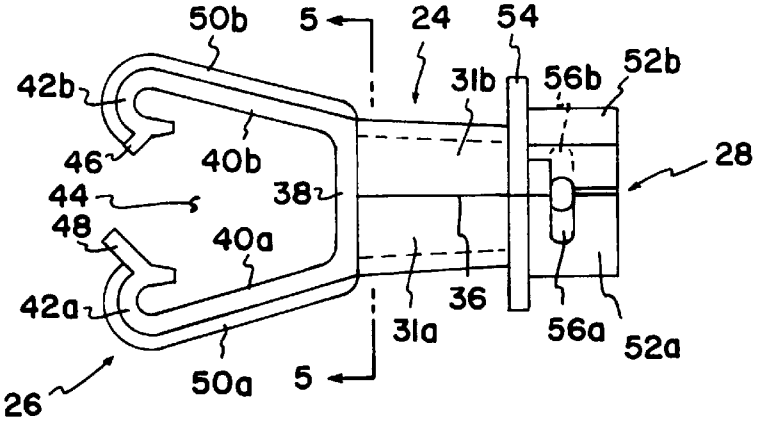
FIG. 3 is a top view of the insulator of the present invention, looking in a direction parallel to the central axis of the mounting clip structure.

With reference now to FIGS. 3 and 5, it is seen that the elongate body portion 24 includes a central member 30 that is formed by a pair of sloped portions 31*a,* 31*b,* with a pair of arms 32, 34 extending downward from the ends of the sloped portions such that the elongate body portion is generally channel shaped in cross-section, as best seen in FIG. 5. The sloped portions 31*a,* 31*b* meet at the center of the member 30 to form a stiffening ridge 36 extending along the length of the body portion 24. The weight of the insulator is thus reduced due to the channel shape of the body portion, with the stiffening ridge ensuring that the body portion is sufficiently rigid. The body portion 24 is preferably elongated such that it has a length sufficient to space the electric wire held by the retainer 28 from the electrically conductive metal structure of the fence 22, thereby preventing electrical short circuits, and to allow the electric wire to clear supporting pipes holding the mesh of the fence 22.

The mounting clip structure 26 is integral with one end of the body portion 24, and includes a central member 38 connected to the body portion, and a pair of arms 40*a,* 40*b* connected to the central member 38 and extending from the ends thereof. As best seen in FIG. 3, the arms 40*a,* 40*b* diverge from each other as they extend from the central member, with the free end of each arm defining a hook 42*a,* 42*b.* An open area 44 having a central axis A (best seen in FIG. 4) is therefore defined between the spaced apart arms. The arms 40*a,* 40*b* are slightly flexible relative to the central member 38, and the distance between the hooks is less than the distance between the parallel wires of the fence, such that when a pair of the adjacent wires are disposed within the hooks, as can be seen in FIG. 2, a clamping force is provided by the arms to retain the insulator on the chain link fence.

With reference again to FIG. 3, it can be seen that the hook 42*b* includes a raised shoulder 46 extending along the height thereof to reinforce the end of the hook. In addition, the hook 42*a* includes a similar shoulder connected thereto that is extended to form a release tab 48 against which a person's fingers can grip to facilitate detachment of the clip from the fence. When the mounting clip structure 26 is to be detached from the fence, a person simply uses a finger or fingers to actuate the tab 48 so as to bend the hook 42*a* and thus release the wire disposed therein. The other wire can then be released from the hook 42*b,* thus freeing the clip from the fence. A reinforcement rib 50*a,* 50*b* extends centrally along the outside surface of each arm 40*a,* 40*b* along the entire length thereof up to the tab 48 and shoulder 46, respectively, in order to reinforce the arms.

Figure 4:
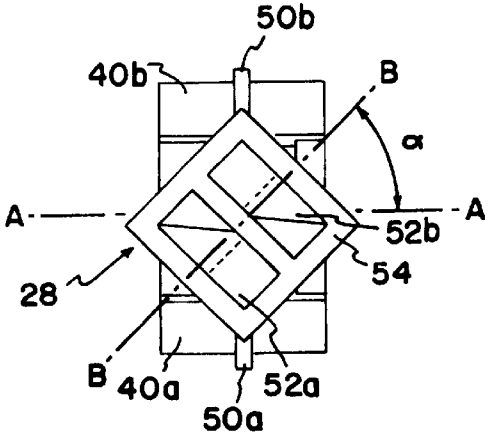
FIG. 4 is an end view of the insulator of the present invention.

The fence strand retainer 28 is integral with the other end of the body portion 24, opposite the mounting clip structure 26. The fence strand retainer 28 is identical to the fence strand retainer disclosed in U.S. Pat. No. 4,028,489, which is hereby incorporated by reference. The retainer 28 includes a pair of laterally spaced hook or jaw members 52*a,* 52*b* integral with a vertical panel 54. The member 52*a* defines an upwardly facing groove 56*a* therein, and the member 52*b* defines a downwardly facing groove 56*b* (illustrated in dashed lines in FIG. 3). The grooves 56*a,b* are aligned with each other to define a fence strand passage for receiving a slender fence strand member, such as electric wire 58, therein. The fence strand passage defined by the grooves 56*a,b* extends along an axis B, as best seen in FIG. 4, with the fence strand member extending generally along the axis B. As the retainer 28 is known in the art, further details thereof are not provided herein. Reference should be made to U.S. Pat. No. 4,028,489 for further details of the construction of the retainer 28.

As can be seen From FIG. 2, since the wires forming the chain link fence are disposed at 45 degree angles, the mounting clip structure 26 and the fence strand retainer 28 must be oriented relative to each other such that when the insulator is attached to the fence 22, the wire held by the insulator 20 is oriented parallel to the ground. In this regard, it can be seen in FIG. 4 that the axis B extends at an acute angle $\alpha$ relative to the central axis A of the mounting clip structure 26. The acute angle $\alpha$ is preferably about equal to the angle of the wires that form the fence 22, which in the illustrated embodiment is about 45 degrees. Therefore, due to the angle $\alpha$, the axis B and the fence strand member extending therealong, are oriented generally parallel to the ground when the mounting clip structure 26 is connected to the fence 22.

Figure 6:
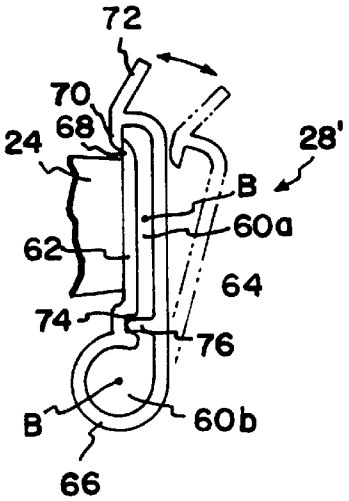
FIG. 6 is a side view of an alternate fence strand retainer.

While the retainer 28 has been described as being formed by a pair of hook or jaw members 52*a,b,* it should be realized that other types of fence strand retainers can be used as well, as long as the fence strand is held by the retainer in a position generally horizontal to the ground. Once such alternate fence strand retainer 28' is illustrated in FIG. 6, with it being understood that the remainder of the insulator is identical to the insulator shown in FIGS. 2–5 and therefore only the retainer 28' is shown. The fence strand retainer 28' is a clip structure that defines a plurality of fence strand passages 60*a,* 60*b* each of which extends along an axis B, and that are oriented at the same acute angle a relative to the central axis of its associated mounting clip structure such that the fence strand member(s) held by the retainer 28' is/are oriented parallel to the ground. Each axis B for the passages 60*a,b* extends vertically into and out of the page as shown in FIG. 6, and like the axis B in the first embodiment, the axes B of the passages 60*a,b* will extend generally parallel to the ground when the insulator is attached to the fence, with the fence strand member(s) in the fence strand passages extending generally along the axes B. The separate fence strand passages 60*a,b* permit the use of different types of fence strand members to be held by the retainer 28', either singly or in combination. For instance, the passage 60*a* is generally elongated for accommodating a broad fence strand member, such as electric tape, while the passage 60*b* is generally circular in shape for accommodating a slender fence strand member, such as electric wire, barbed wire, or rope.

The clip structure 28' includes a first portion 62 connected to the end of the body portion 24, and a second, moveable portion 64 doubled back over the first portion and connected thereto by a curved end portion 66. The curved end portion 66 resiliently connects the first and second portions together, thereby forming a hinge between the first and second portions 62, 64 to allow the second portion to move toward and away from the first portion, as shown by the arrow and the dashed lines in FIG. 6. The end of the first portion 62 opposite the curved end 66 defines a locking shoulder 68, and the end of the second portion 64 opposite the end 66 includes a locking tab 70 which is engageable behind the locking shoulder 68 to form a selectively releasable connection between the first and second portions. A release tab 72 is connected to the locking tab 70 for releasing the connection between the locking shoulder and locking tab. The tab 72 can be actuated using a thumb or finger so as to pivot the locking tab 70 away from locking engagement with the locking shoulder 68, thereby permitting release of the connection. A notch 74 is formed in the first portion 62 and a finger 76 extends from the second portion 64 and is received within the notch when the first and second portions are engaged (as seen in solid lines in FIG. 6), to thereby separate the passages 60*a,b.* The retainer 28' is generally identical to the clip disclosed in copending patent application Ser. No. 08/925,576, commonly owned by the Assignee of the present invention, and which is hereby incorporated by reference in its entirety.

As an alternative, the fence strand retainer 28' could be formed such that the notch 74 and finger 76 are removed, and therefore the separate passages 60*a,b* are instead connected together, thereby forming a single fence strand passage. This single passage would also be able to accommodate a variety of different fence strand members.

It is to be understood that while certain embodiments of the present invention have been illustrated and described, the invention is not limited to the specific forms or arrangements of parts described and shown. Rather, the invention is defined by the following claims.

We claim:

1. An insulator for a fence, comprising:

an elongate body portion having first and second ends;

a mounting structure at the first end of the body portion for attaching the body portion to a fence, said mounting structure including a central axis extending therethrough;

a fence strand retainer at the second end of the body portion for securing a fence strand member to the body portion, said fence strand retainer including a fence strand passage that is oriented at an acute angle relative to said central axis of the mounting structure; and said body portion, said mounting structure, and said fence strand retainer being a one-piece construction of a non-conducting material.

2. The insulator according to claim 1, wherein said acute angle is about 45 degrees.

3. The insulator according to claim 1, wherein said non-conducting material comprises plastic.

4. The insulator according to claim 1, wherein said mounting structure comprises a clip.

5. The insulator according to claim 4, wherein said clip comprises first and second arms extending from a central member that is connected to said body portion.

6. The insulator according to claim 5, wherein each of said first and second arms includes a hook on an end thereof opposite said center member.

7. The insulator according to claim 6, wherein said arms diverge from said central member whereby said hooks are spaced apart from each other.

8. The insulator according to claim 6, further including a release tab connected to one of said hooks.

9. The insulator according to claim 6, further including a reinforcement rib extending along each of said first and second arms and each of said hooks.

10. An insulator for a chain link fence, comprising:

an elongate, plastic body portion;

a plastic clip structure at one end of the body portion for attaching the body portion to a chain link fence, said plastic clip structure including a central axis extending therethrough;

a fence strand retainer at an opposite end of the body portion, said fence strand retainer being made of plastic and including a fence strand passage that is oriented at an acute angle relative to said central axis of the plastic clip structure; and said body portion, said clip structure, and said fence strand retainer being a one-piece construction.

11. The chain link fence insulator according to claim 10, wherein said acute angle is about 45 degrees.

* * * * *